US010974861B2

(12) United States Patent
Liming et al.

(10) Patent No.: US 10,974,861 B2
(45) Date of Patent: Apr. 13, 2021

(54) CONTAINER HAVING ENHANCED WALL INTEGRITY AND ALIGNMENT ELEMENT

(71) Applicant: Huhtamaki, Inc., De Soto, KS (US)

(72) Inventors: Mike Liming, New Vienna, OH (US); Don Tomalia, Midland, MI (US); Joe Trombley, Auburn, MI (US); Pete Brushaber, Beaverton, MI (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

(21) Appl. No.: 16/154,214

(22) Filed: Oct. 8, 2018

(65) Prior Publication Data

US 2019/0039774 A1 Feb. 7, 2019

Related U.S. Application Data

(60) Division of application No. 15/090,280, filed on Apr. 4, 2016, which is a continuation of application No.
(Continued)

(51) Int. Cl.
*B65D 21/02* (2006.01)
*A47G 19/23* (2006.01)
(Continued)

(52) U.S. Cl.
CPC ..... *B65D 1/44* (2013.01); *A45F 3/20* (2013.01); *A47G 19/03* (2013.01); *A47G 19/23* (2013.01);
(Continued)

(58) Field of Classification Search
CPC ..... A45F 3/20; A47G 19/23; B65D 21/0233; B65D 21/0234; B65D 21/043; B65D 21/04; B65D 21/048; B65D 88/025
(Continued)

(56) References Cited

U.S. PATENT DOCUMENTS 2,218,388 A * 10/1940 Twombly ..... B65D 1/34 206/515
D144,300 S 4/1946 Nicholson
(Continued)

FOREIGN PATENT DOCUMENTS

CA 2581275 A1 4/2006
CA 2597017 A1 9/2006
(Continued)

*Primary Examiner* — Allan D Stevens
(74) *Attorney, Agent, or Firm* — Husch Blackwell LLP

(57) ABSTRACT

A container having enhanced wall integrity and a rotational element is provided that includes a sidewall having polygonal cross-sectional shape and an alignment structure formed therein. The alignment structure is adapted for orienting the container with respect to a second container such that the panel sections of the containers become parallel with one another and the containers may be fully nested one within the other. The alignment structure can be recessed into the sidewall to form peaks and valleys along an inner surface of the container. The peaks include first and second faces sloping in opposite directions designed to direct corners of the first container's sidewall toward the interior valleys of the second container in order to orient the containers as they are stacked.

9 Claims, 9 Drawing Sheets

Related U.S. Application Data

13/162,307, filed on Jun. 16, 2011, now Pat. No. 9,314,089.

(51) Int. Cl.

| | |
|---|---|
| ***B65D 1/44*** | (2006.01) |
| ***A47G 19/03*** | (2006.01) |
| ***A45F 3/20*** | (2006.01) |
| ***B65D 1/00*** | (2006.01) |
| ***B65D 1/42*** | (2006.01) |
| ***B65D 1/26*** | (2006.01) |

(52) U.S. Cl.

CPC ..... *B65D 1/00* (2013.01); *B65D 1/26* (2013.01); *B65D 1/265* (2013.01); *B65D 1/42* (2013.01); *B65D 21/02* (2013.01); *B65D 21/0233* (2013.01)

(58) Field of Classification Search

USPC ..... 215/10; D7/530, 531

See application file for complete search history.

(56) References Cited

U.S. PATENT DOCUMENTS

| | | | | | |
|---|---|---|---|---|---|
| 2,412,178 | A | * | 12/1946 | Seigh | B65D 7/04 206/519 |
| D177,630 | S | | 5/1956 | Kohl | |
| 2,931,535 | A | * | 4/1960 | Lockwood | B65D 21/048 206/507 |
| 3,091,360 | A | | 5/1963 | Edwards | |
| 3,094,240 | A | * | 6/1963 | Wanderer | B65D 21/0233 206/519 |
| D196,271 | S | | 9/1963 | Edwards | |
| D197,313 | S | | 1/1964 | Wanderer | |
| 3,194,468 | A | * | 7/1965 | Baron | B65D 1/44 229/400 |
| D204,212 | S | * | 3/1966 | Davis | D9/429 |
| 3,288,340 | A | | 11/1966 | Shapiro et al. | |
| 3,437,253 | A | * | 4/1969 | McDonald | B65D 1/265 229/400 |
| 3,483,908 | A | | 12/1969 | Donovan | |
| 3,530,917 | A | | 9/1970 | Donovan | |
| D223,999 | S | | 6/1972 | Klote | |
| 3,934,725 | A | * | 1/1976 | Edwards | B65D 1/265 206/519 |
| D244,740 | S | | 6/1977 | Durand | |
| D271,083 | S | | 10/1983 | Tyler | |
| 4,446,969 | A | | 5/1984 | Tyler | |
| 4,578,296 | A | | 3/1986 | Miyazaki et al. | |
| D308,318 | S | | 6/1990 | Durand | |
| 5,040,698 | A | * | 8/1991 | Ramsey | B65D 1/165 220/671 |
| D321,652 | S | | 11/1991 | Palisin, Jr. | |
| 5,267,685 | A | * | 12/1993 | Sorensen | B65D 21/0233 206/503 |
| D362,786 | S | | 10/1995 | Andress et al. | |
| D381,558 | S | * | 7/1997 | Schaefer | D7/523 |
| D415,025 | S | | 10/1999 | McCann | |
| D428,307 | S | | 7/2000 | Yeandel | |
| D438,794 | S | | 3/2001 | Miles et al. | |
| D448,243 | S | | 9/2001 | Kehrein | |
| D510,679 | S | | 10/2005 | Smith et al. | |
| D515,358 | S | | 2/2006 | Orr et al. | |
| D574,192 | S | * | 8/2008 | Schosser | D7/509 |
| D595,090 | S | | 6/2009 | Benson | |
| 7,546,932 | B2 | | 6/2009 | Smith et al. | |
| D608,591 | S | | 1/2010 | Hillebrenner et al. | |
| 7,699,216 | B2 | | 4/2010 | Smith et al. | |
| D618,962 | S | | 7/2010 | Liming | |
| D627,636 | S | | 11/2010 | Fang | |
| 8,025,210 | B2 | | 9/2011 | Johnson et al. | |
| D649,034 | S | | 11/2011 | Cimmerer et al. | |
| D745,386 | S | * | 12/2015 | Covey | D9/416 |
| D801,807 | S | * | 11/2017 | Rapparini | D9/429 |
| 2003/0094393 | A1 | * | 5/2003 | Sahm, III | B65D 1/42 206/505 |
| 2006/0076395 | A1 | | 4/2006 | Hayes et al. | |
| 2006/0226162 | A1 | | 10/2006 | Hayes et al. | |
| 2007/0289892 | A1 | * | 12/2007 | Hogerty | B65D 21/0219 206/515 |
| 2009/0020597 | A1 | | 1/2009 | D'Amato | |
| 2009/0277812 | A1 | * | 11/2009 | Driscoll | A47G 19/23 206/499 |
| 2010/0072268 | A1 | | 3/2010 | Johnson et al. | |
| 2011/0220665 | A1 | * | 9/2011 | McDonnell | B65D 21/0212 220/592.17 |
| 2012/0012647 | A1 | | 1/2012 | Almabekov | |
| 2017/0042362 | A1 | * | 2/2017 | Bunner | B65D 1/46 |

FOREIGN PATENT DOCUMENTS

| | | | | |
|---|---|---|---|---|
| DE | 1216139 | | 5/1966 | |
| GB | 716006 | | 9/1954 | |
| GB | 716006 | A * | 9/1954 | B65D 21/043 |
| GB | 1096451 | | 12/1967 | |
| GB | 1251595 | | 10/1971 | |
| WO | 2006043971 | A1 | 4/2006 | |
| WO | 2006093952 | A1 | 9/2006 | |

* cited by examiner

CONTAINER HAVING ENHANCED WALL INTEGRITY AND ALIGNMENT ELEMENT

CROSS-REFERENCE TO RELATED APPLICATIONS

This Application is a Divisional of U.S. application Ser. No. 15/090,280 entitled "Container Having Enhanced Wall Integrity and Alignment Element," filed on Apr. 4, 2016 and currently pending, which is a Continuation of U.S. application Ser. No. 13/162,307 entitled "Container Having Enhanced Wall Integrity and Alignment Element," filed on Jun. 16, 2011 and now issued as U.S. Pat. No. 9,314,089. The entire disclosure of U.S. application Ser. No. 15/090,280 and U.S. application Ser. No. 13/162,307 is incorporated herein by reference.

BACKGROUND OF THE INVENTION

Thin-walled disposable plastic containers made by conventional thermoforming techniques have long been known in the art. Such containers, which are often used to hold food and beverage, are frequently used at parties, gatherings and other occasions where little or no clean-up is desired. Although these thermoplastic containers offer consumers with many benefits, there are drawbacks affiliated with their manufacture and use. For example, because of their extremely thin walls, these containers are subject to bending, distortion, collapsing and crushing when they are grasped by a user.

The art has turned to a number of devices and means for strengthening such containers. One solution has been to provide thicker material construction. However, this increases production costs. Another solution, as set forth in U.S. Pat. No. 6,554,154, has been to provide annular ribs in the container sidewall. However, the strength enhancement that may be achieved by using annular ribs is limited, especially in the middle regions of the sidewall, where gripping normally occurs.

Another drawback with such containers, particularly those containers having cross-sectional shapes that may, at least partially, be non-round, involves the containers not fully nesting one within the other when they are stacked. As is known in the art, containers are stacked one on top of the other during shipment, storage and dispensing. When stacked it is desirable that the containers be fully nested. If the containers are not fully nested, the stack of containers will take up more space than necessary and may become unstable. Additionally, it can result in multiple containers sticking together when a user intends to grab only one container from the stack.

Accordingly, a need exists for a disposable plastic container having a sidewall of increased strength, while avoiding the use of thicker material. A need also exists for a plastic container having features for ensuring the container becomes fully nested in a stack of containers.

SUMMARY OF THE INVENTION

One embodiment of the present invention is directed to a container including a bottom wall, a plurality of sidewall panel sections extending upwardly from the bottom wall and a generally axially-extending rotational element or alignment structure associated with at least one of the panel sections. The panel sections form a generally frustoconical sidewall having a polygonal cross-sectional shape (e.g., decagon or dodecagon). Corners, each of which may contain a generally longitudinal outwardly protruding rib, may be formed at the intersecting regions located between adjacent panel sections. The alignment structure is adapted for orienting or rotating the container with respect to a second generally identical container along a longitudinal axis such that the respective panel sections of the containers are substantially parallel with one another and the containers may be fully nested one within the other.

The alignment structure may either be recessed into the sidewall, protruding from the sidewall or a combination of both recessed into and protruding from the sidewall. In one embodiment, the alignment structure is at least partially protruding from the sidewall. In another embodiment, the alignment structure is at least partially indented into the sidewall and extends inwardly into an interior of the container forming radially intermittent peaks and valleys along the interior surface of the container. The peaks formed along the interior surface of the container include sloping first and second faces adapted for directing the corners or ribs of the second container toward the valleys of the first container such that the sidewall panel sections of the second container become oriented substantially parallel with the corresponding sidewall panel sections of the first container so that the two containers can become fully nested Another embodiment of the present invention is directed to a container wherein the alignment structure comprises a plurality of fingers indented into the sidewall and extending inwardly into an interior of the container forming radially intermittent peaks and valleys along the interior and exterior surfaces of the container. Each finger may be tapered and decrease in width from a wider lower end to a narrower upper end. The valleys along the interior surface of the sidewall are tapered and increase in width from a narrower lower end to a wider upper end. The valleys along the interior surface are adapted for receiving the fingers of a second generally identical container when the second container is placed within the first container such that the sidewall panel sections of the second container become aligned substantially parallel with the sidewall panel sections of the first container so that the two containers can become fully nested.

Other and further objects of the invention, together with the features of novelty appurtenant thereto, will appear in the course of the following description.

BRIEF DESCRIPTION OF THE SEVERAL VIEWS OF THE DRAWING

In the accompanying drawings, which form a part of the specification and are to be read in conjunction therewith in which like reference numerals are used to indicate like or similar parts in the various views.

DESCRIPTION OF THE PREFERRED EMBODIMENT

Figure 1:
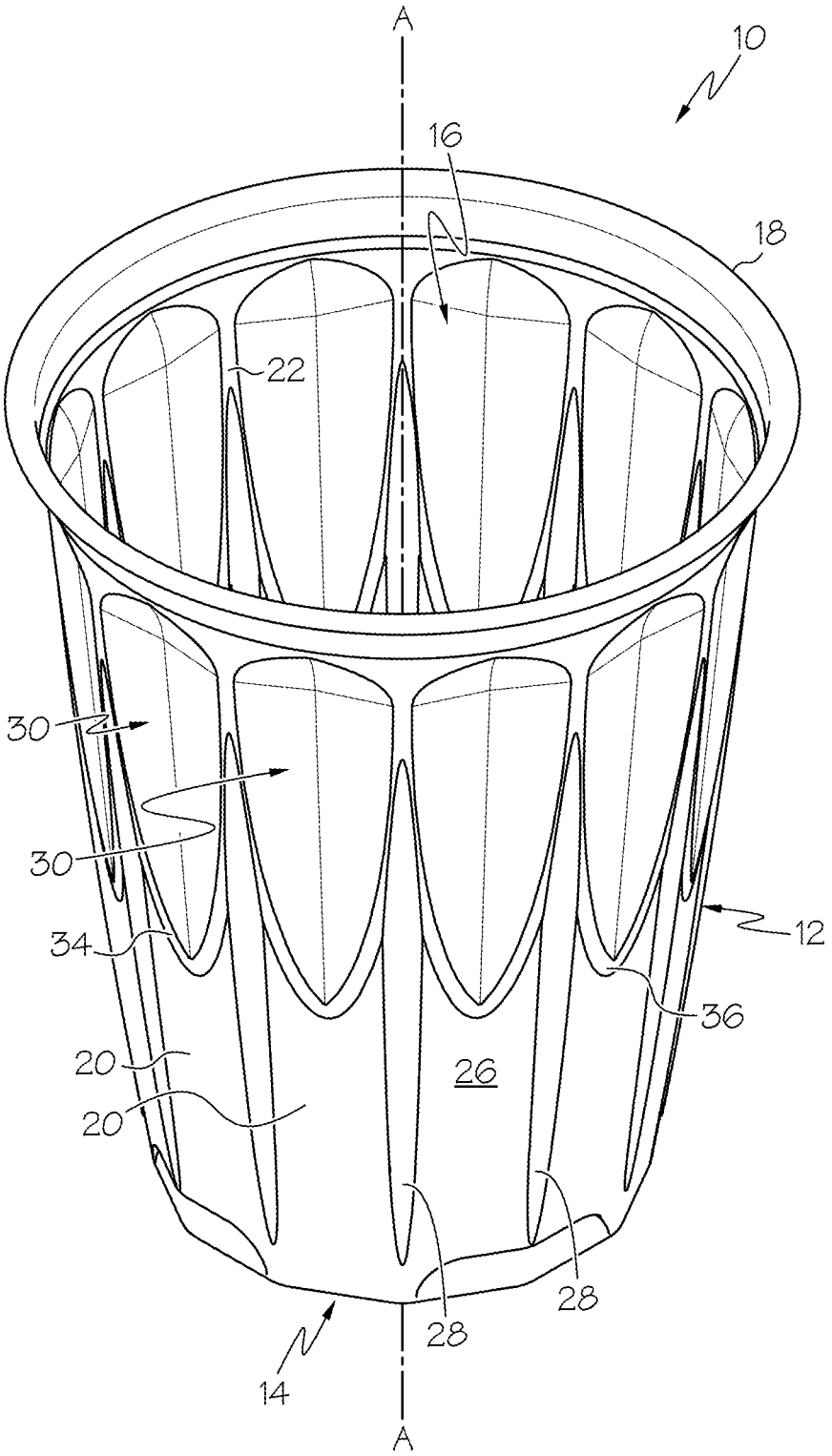
FIG. 1 is a side perspective view of a container in accordance with a preferred embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

A storage container 10 embodying various features of the present invention is shown in the figures. The container 10 may be suitable for holding food and beverage products or any other goods or products that would typically be held within a container. In a first embodiment, as shown generally in FIGS. 1-3B, the container 10 includes a circumferential sidewall 12 extending upwardly from a bottom wall 14. The sidewall has interior and exterior surfaces 22 and 26. An annular rolled rim or lip 18 may be provided at the top end of the sidewall 12 to form a comfortable drinking surface for the mouth of a user, may provide rigidity to the top of the container 10 and, optionally, for attaching a lid (not shown) to the container 10.

The container 10 preferably is an open-ended container of any suitable size, shape and configuration. In one embodiment, the container 10 has a frustoconical shape; that is, the container 10 has a generally circular cross-section decreasing in diameter as the sidewall 12 tapers from top to bottom such that the top open mouth 16 is generally larger than the bottom wall 14. The upwardly and outwardly taper of the container 10 provides a means for stacking a plurality of containers 10, as illustrated in FIGS. 2A-3B. It will be appreciated, however, by those skilled in the art that different shapes may serve equally as well and may be required by a desired application. The container 10 may be manufactured of a thin polymeric, non-polymeric or plastic material and in manner utilizing a thermoforming process as is typically known in the art. As such, the container 10 can be made of materials such as polyethylene, polypropylene, polyester, polystyrene or another suitable material now known or hereafter developed.

In order to increase the structural rigidity and integrity of the sidewall 12, as compared to commonly-known round containers, the sidewall 12 may have a generally symmetrical polygonal cross-sectional shape. This sidewall 12 structure increases the strength and rigidity of the sidewall 12, allowing the sidewall 12 to be made thinner, thereby potentially reducing the container's 10 weight and cost. The sidewall's 12 cross-sectional shape may take a variety of shapes, including but not limited to, octagonal, nonagonal, decagonal, hendecagonal, dodecagonal or any other suitable polygonal shape.

The sidewall 12 may be formed of a plurality of generally rectangular-shaped panel sections 20 extending upwardly from the container's bottom wall 14. As set forth above and shown in the figures, the sidewall 12 has an upwardly and outwardly taper allowing a plurality of containers 10 to be stacked or nested together during shipping and storage. The sidewall 12 may be of any suitable size, shape and configuration. As such, in one embodiment, each sidewall panel section 20 is in the shape of an isosceles trapezoid in order for the container 10 to have a generally frustoconical shape. Similar to the sidewall 12, panel sections 20 are each tapered such that they are wider at their top ends and narrower at their lower ends.

When a plurality of containers 10 having polygonal sidewalls 12 are stacked one on top of the other, it is generally preferred that the respective sidewall panel sections 20 of the containers 10, particularly those of two adjacently-stacked containers 10, are aligned parallel with one another so that the containers 10 become fully nested one within the other. However, when such containers 10 are stacked, it is common that the two adjacently-stacked containers 10 will be oriented in a manner such that their respective sidewall panel sections 20 are not aligned parallel to each other. In such a case, the containers 10 cannot become fully nested. When this happens, the stack of containers 10 may be more susceptible to tipping and will take up more space than if all of the containers 10 were fully nested. Additionally, it can result in multiple containers sticking together during the manufacturing process or when a user intends to grab only one container from the stack. Thus, it is desirable for the respective panel sections 20 of adjacently-stacked containers 10 to be aligned.

As illustrated in FIG. 1, the container 10 includes at least one generally axially-extending rotational element or alignment structure 30 associated with one or more of the sidewall panel sections 20 for urging misaligned containers 10 to become aligned. In doing so, the alignment structure 30 is adapted to cause one container 10 to rotate and orient itself with respect to a second container 10 about a longitudinal axis A-A as the two containers 10 are being stacked.

Figure 2A:
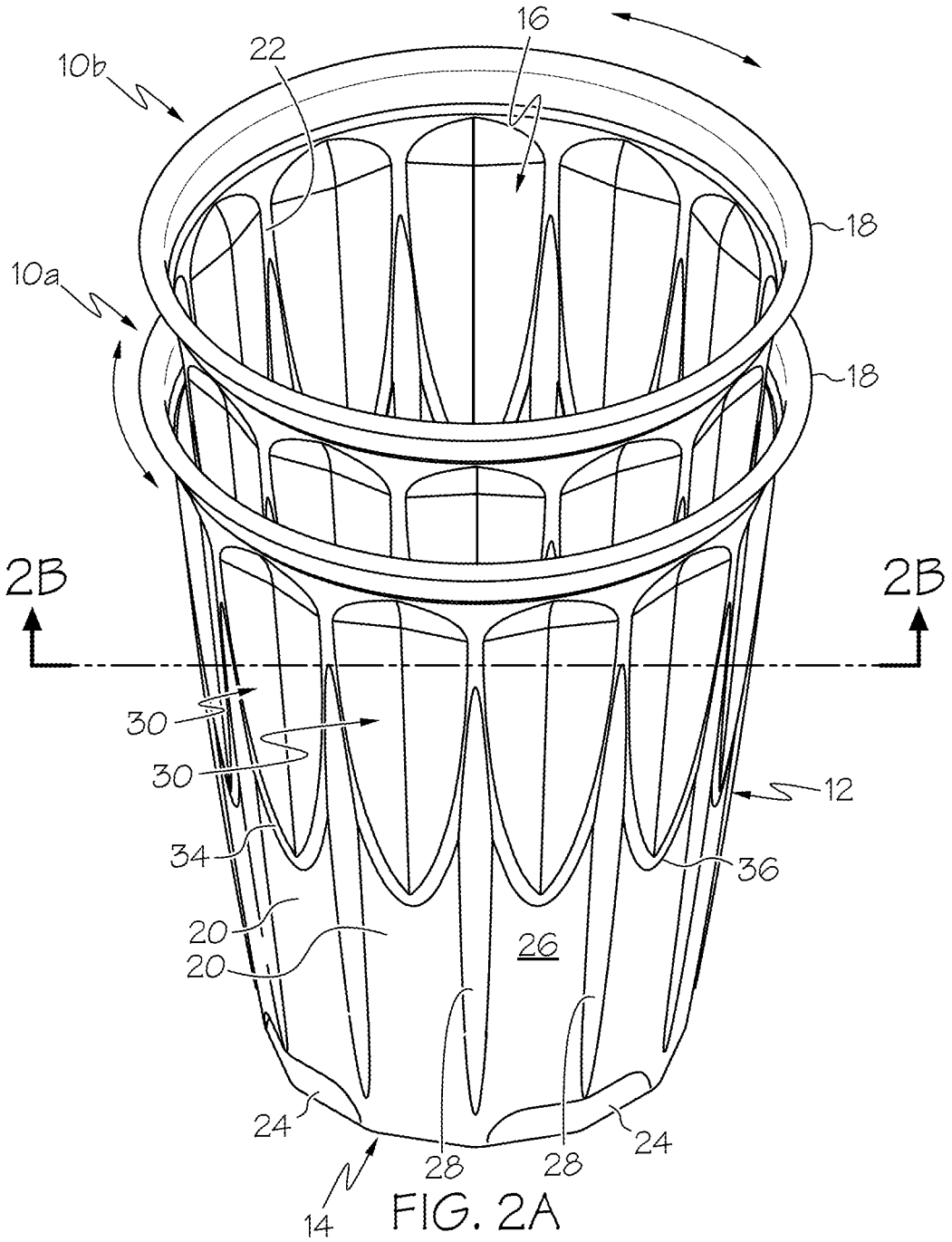
FIG. 2A is a side perspective view of two partially nested containers having their respective panel sections angularly offset from one another in accordance with a preferred embodiment of the present invention.
Figure 2B:
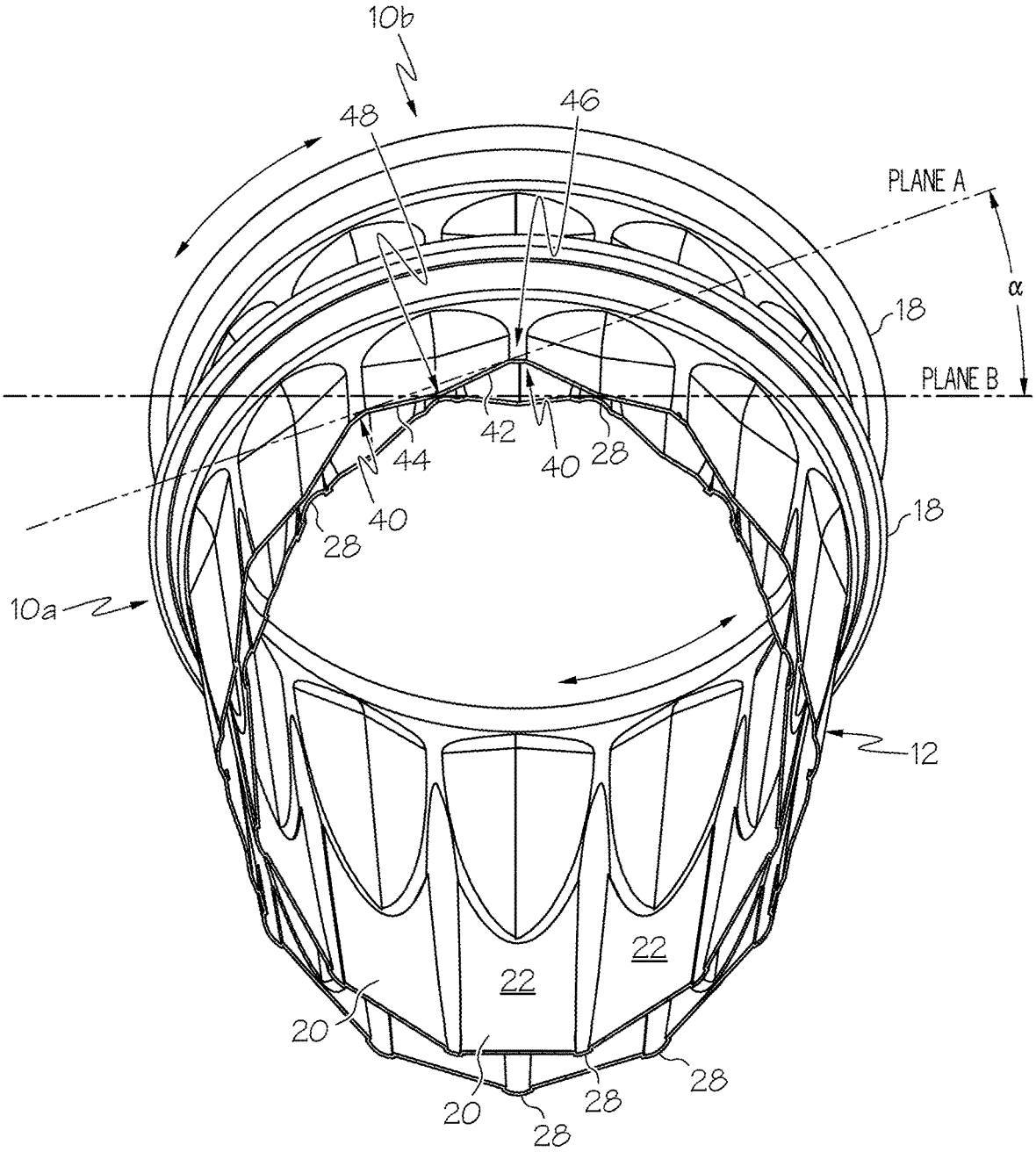
FIG. 2B is a sectional view of the containers of FIG. 2A taken generally along line 2B-2B in the direction of the arrows in accordance with a preferred embodiment of the present invention.

As shown in FIGS. 2A and 2B, when one container 10*a* is partially inserted within another generally identical container 10*b* during the stacking process, the two containers 10*a* and 10*b* may not be aligned with one another as described above. In FIG. 2B, one of the panel sections 20 of one container 10*a* lies in plane A while the respective panel section of the other container 10*b* lies in plane B. As demonstrated, the two containers 10*a* and 10*b* are axially misaligned from one another by an angle $\alpha$. Absent the alignment structure 30, the two containers 10*a* and 10*b* would not rotate axially with respect to one another and therefore would never become fully nested.

As shown in FIGS. 1-3B, the container 10 may include ribs 28 protruding outwardly from the corners formed at the intersections of adjacent sidewall panel sections 20. In another embodiment, the container does not include such ribs 28 protruding from its corners.

Figure 3A:
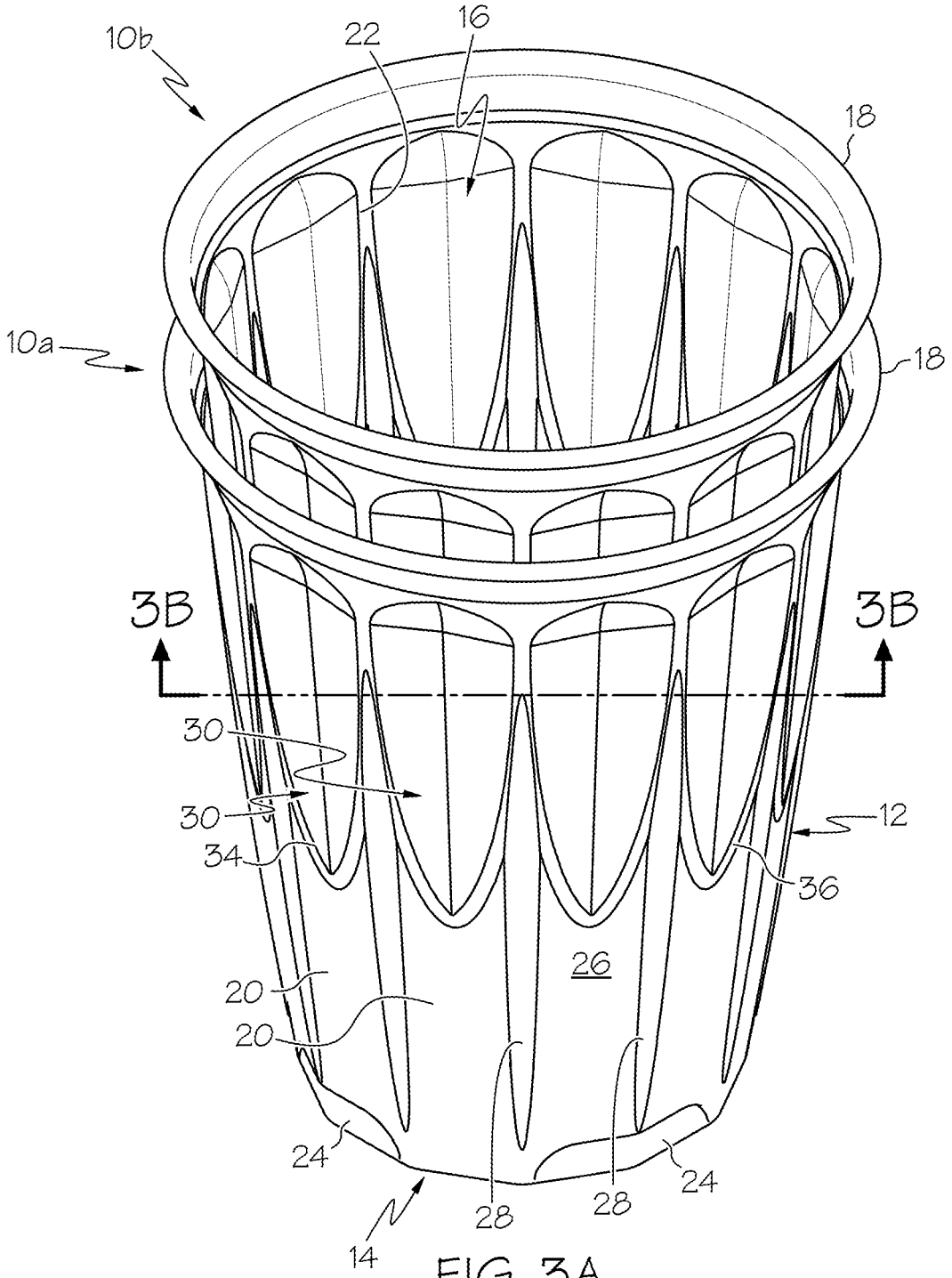
FIG. 3A is a side perspective view of two partially nested containers having their respective panel sections parallel with one another in accordance with a preferred embodiment of the present invention.
Figure 3B:
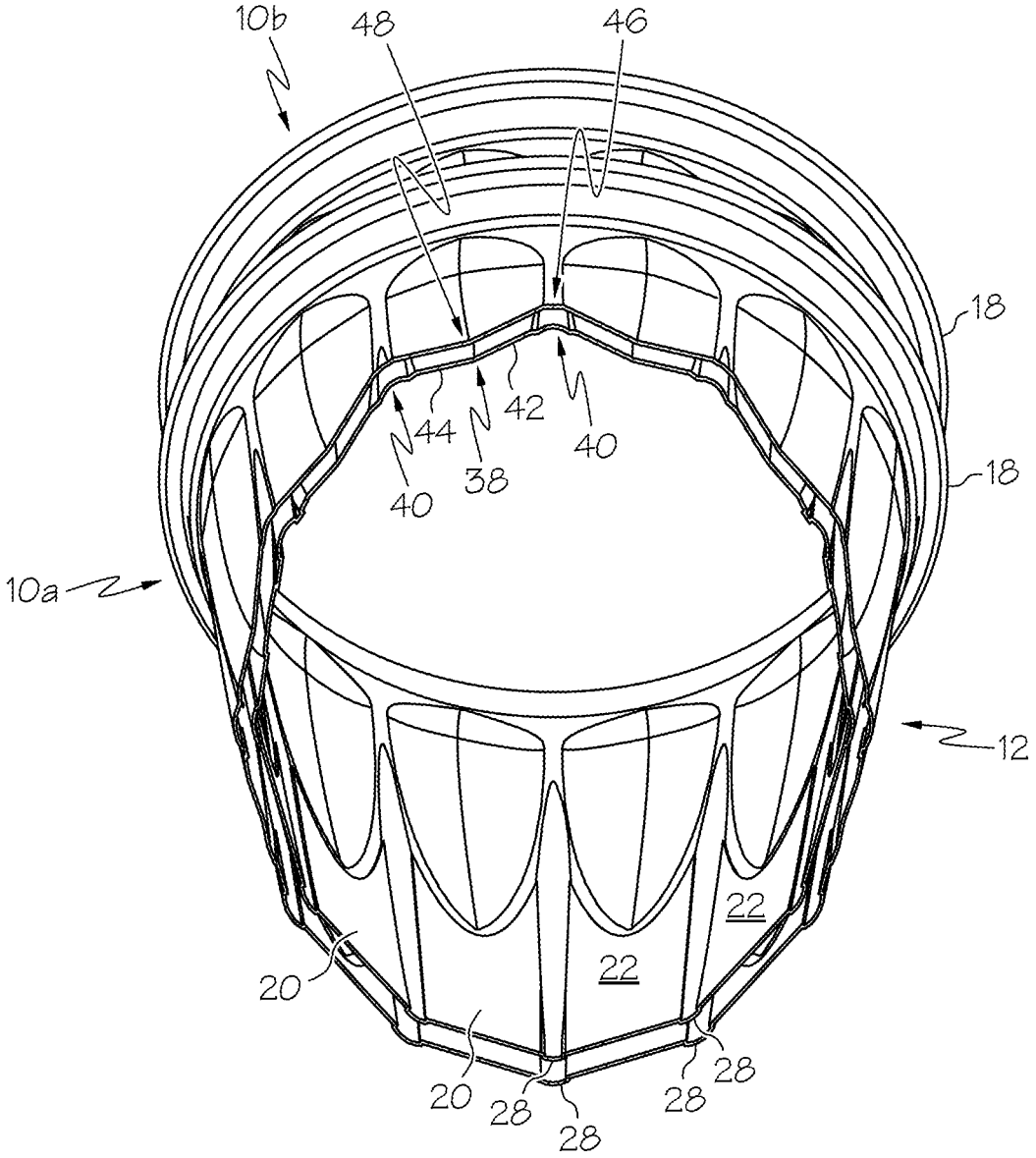
FIG. 3B is a sectional view of the containers of FIG. 3A taken generally along line 3B-3B in the direction of the arrows in accordance with a preferred embodiment of the present invention.

In the embodiment illustrated in FIGS. 1-3B, the alignment structures 30 of container 10 are at least partially recessed within the sidewall 12. In other words, the alignment structures 30 are indented into the exterior surface 26 of the sidewall 12 and, thus, correspondingly protrude inwardly from the interior surface 22 of the sidewall 12 into the interior of the container 10. The alignment structures 30 can each be shaped to include a boundary edge 34, which may protrude outwardly from the exterior surface 26 of the sidewall 12 and form a v-shaped lower edge 36. As shown in FIGS. 2B and 3B, because the alignment structure 30 is recessed into the sidewall 12, a resulting alternating series of generally radially intermittent, circumferentially-spaced peaks 38 and valleys 40 are formed into the interior surface 22 of the sidewall 12. Each interior peak 38 is divided to include first and second faces 42 and 44 sloping in opposite directions. Due to its formation into the sidewall 12, the alignment structure 30 also results in an alternating series of generally circumferentially-spaced peaks 46 and valleys 48 formed into the exterior surface 26 of the sidewall 12.

The alignment structure 30 urges one container 10*a* (or container 10*b*, as the case may be) to rotate with respect to an adjacently stacked container 10*b* (or container 10*a*, as the case may be). It should be understood that the containers 10 may be stacked in an upright orientation, such that one container 10*b* is placed within another container 10*a*, or stacked in an upside-down orientation, such that one container 10*a* is placed over another container 10*b*. The alignment structures 30 are designed to cause rotational movement of one container 10 with respect to another container 10 until and to the point where the respective sidewall panel sections 20 of the containers 10 are generally aligned parallel with one another as shown in FIGS. 3A and 3B. As one container 10*b* is inserted into another container 10*a*, the corners (or the ribs 28 protruding therefrom) of the first container 10*b* engage the interior peaks 38 of the second container 10*a*. As described above, the peaks 38 each have first and second faces 42 and 44 meeting at an apex and sloping away from one another. The apex of each peak 38 splits the peak 38 and causes the corner (or protruding rib 28) of the other container to engage either the first face 42 or second face 44 of the peak 38.

FIGS. 2A and 2B illustrates one container 10*a* partially inserted within another container 10*b* during the stacking process, wherein the two containers 10*a* and 10*b* are not be aligned with one another. The ribs 28 of container 10*b* contact the interior peaks 38 of container 10*a* as the two containers 10*a* and 10*b* are stacked. The ribs 38 are directed to either the first faces 42 or second faces 44 of the peaks 38. If the ribs 28 engage the first faces 42, then container 10*b* will rotate clockwise (as shown from this angle) with respect to container 10*b* as the two containers 10*a* and 10*b* become stacked. If the ribs 28 engage the second faces 44, then container 10*b* will rotate counter-clockwise (as shown from this angle) with respect to container 10*b* as the two containers 10*a* and 10*b* become stacked. Such rotation will continue to the point where the respective sidewall panel sections 20 of the containers 10*a* and 10*b* are substantially aligned parallel with one another, as shown in FIGS. 3A and 3B. In this sense, the containers 10 are adapted to be generally self-aligning. Consequently, little or no manipulation may be required for the containers 10 to properly nest.

As demonstrated in FIG. 3B, when the respective sidewall panel sections 20 of the containers 10*a* and 10*b* are aligned parallel with one another, the corners or ribs 28 of container 10*b* are generally received within the valleys 40 of container 10*a*. Once the containers 10*a* and 10*b* are aligned with one another, as shown in FIGS. 3A and 3B, the containers 10*a* and 10*b* may become fully nested. The containers 10*a* and 10*b* are considered fully nested when the bottom of one container 10*b* comes into contact with the one or more stacking shoulders 24 indented into the other container 10*a*.

The alignment structure 30 may have a parabolic-like shape, as shown in FIG. 1, a curvilinear shape or any other shape suitable for achieving the alignment outcome described herein. The alignment structure 30 may be either recessed into the sidewall 12, protruding outwardly from the sidewall 12 or both recessed into and protruding outwardly from the sidewall 12. In one embodiment, the container 10 includes some alignment structures 30 which are recessed into the sidewall 12 and some alignment structures 30 that are protruding therefrom. The alignment structure 30 can increase the structural rigidity and integrity of the sidewall 12 and can provide the sidewall 12 with contoured edges which aid a user in gripping the container 10.

Figure 4:
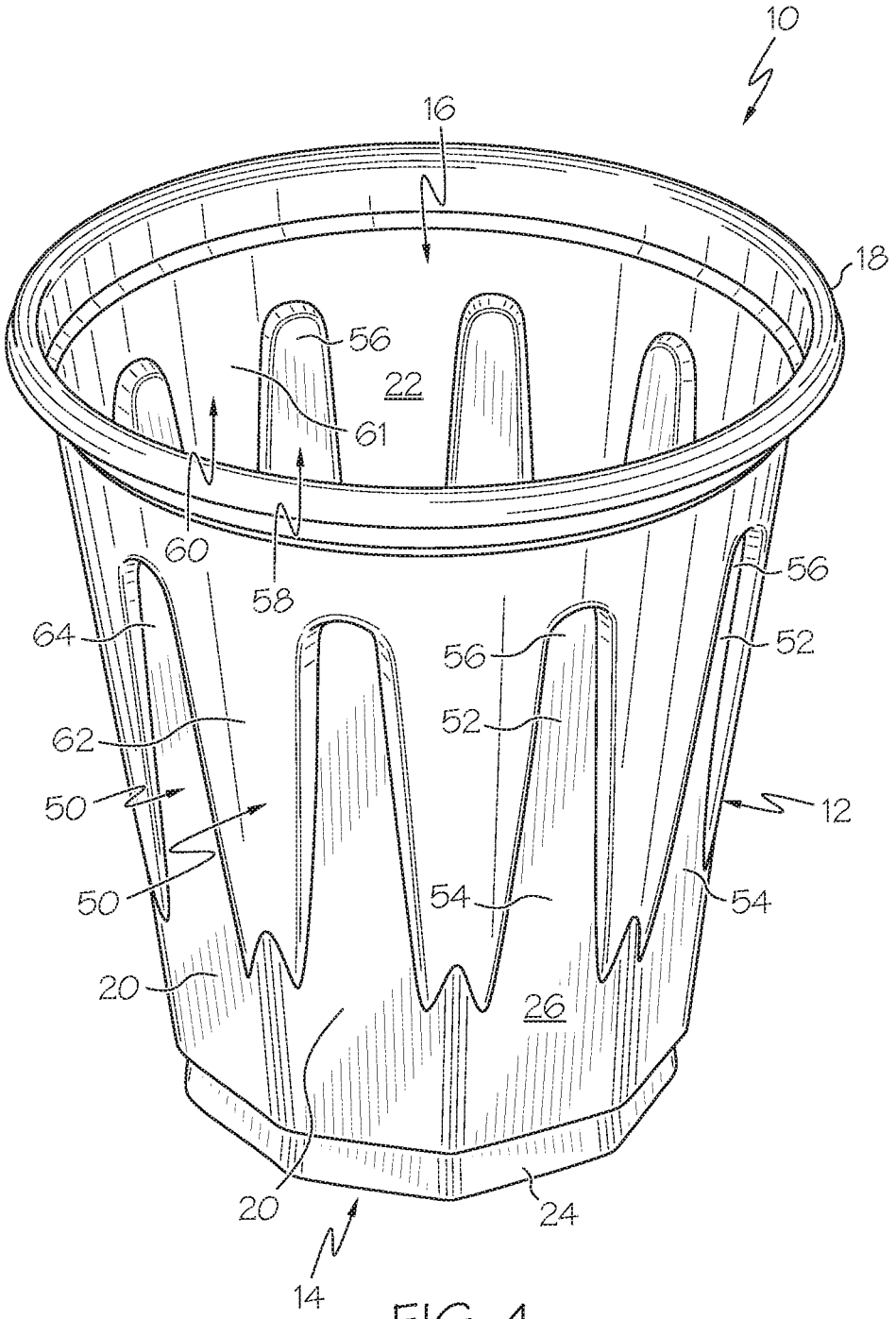
FIG. 4 is a side perspective view of a container having identical finger structures in accordance with a preferred embodiment of the present invention.

Turning now to another embodiment, FIG. 4 shows a container 10.1 having an alignment structure 50 that comprises a plurality of circumferentially-spaced fingers 52 that may be recessed into or protruding from the container's sidewall 12. In the illustrated embodiment, the fingers 52 are indented into the sidewall 12 and extend inwardly into an interior of the container 10.1 The indented fingers 52 form radially intermittent peaks 58 and valleys 60 along the interior surface 22 of the sidewall 12. They also form corresponding peaks 62 and valleys 64 along the outer surface 26 of the sidewall 12. The fingers 52 have first and second ends 54 and 56. In FIG. 4, the fingers 52, which form the peaks 60 along the interior surface 22 of the sidewall 12, are tapered and decrease in width from a wider first (lower) end 54 to a narrower distal second (upper) end 56. Correspondingly, the valleys 60 along the interior surface 22 of the sidewall 12 are tapered and increase in width from a narrower lower (not shown) end to a wider upper end 61.

The valleys 60 formed into the inner surface 22 of the sidewall 12 of one container are adapted for receiving the peaks 62 protruding from the outer surface 26 of a second generally identical container (not shown) when the second container is placed within the container 10.1. Likewise, the valleys 64 formed into the outer surface 26 of the sidewall 12 of one container are adapted for receiving the peaks 58 formed into the interior surface 22 of a second generally identical container (not shown) when the second container is placed within the container 10.1. As the containers 10.1 are stacked together, the narrow ends of the peaks 58 and 62 engage the wide ends of the valleys 64 and 60, respectively. This engagement of the tapered peaks 58 and 62 and tapered valleys 64 and 60 aligns the two containers as they move closer together during the stacking process such that the sidewall panel sections 20 of the containers are aligned substantially parallel to one another. Like alignment structures 30, alignment structures 50 can increase the structural rigidity and integrity of the sidewall 12 and can provide the sidewall 12 with contoured edges which aid a user in gripping the container 10.1.

Figure 5:
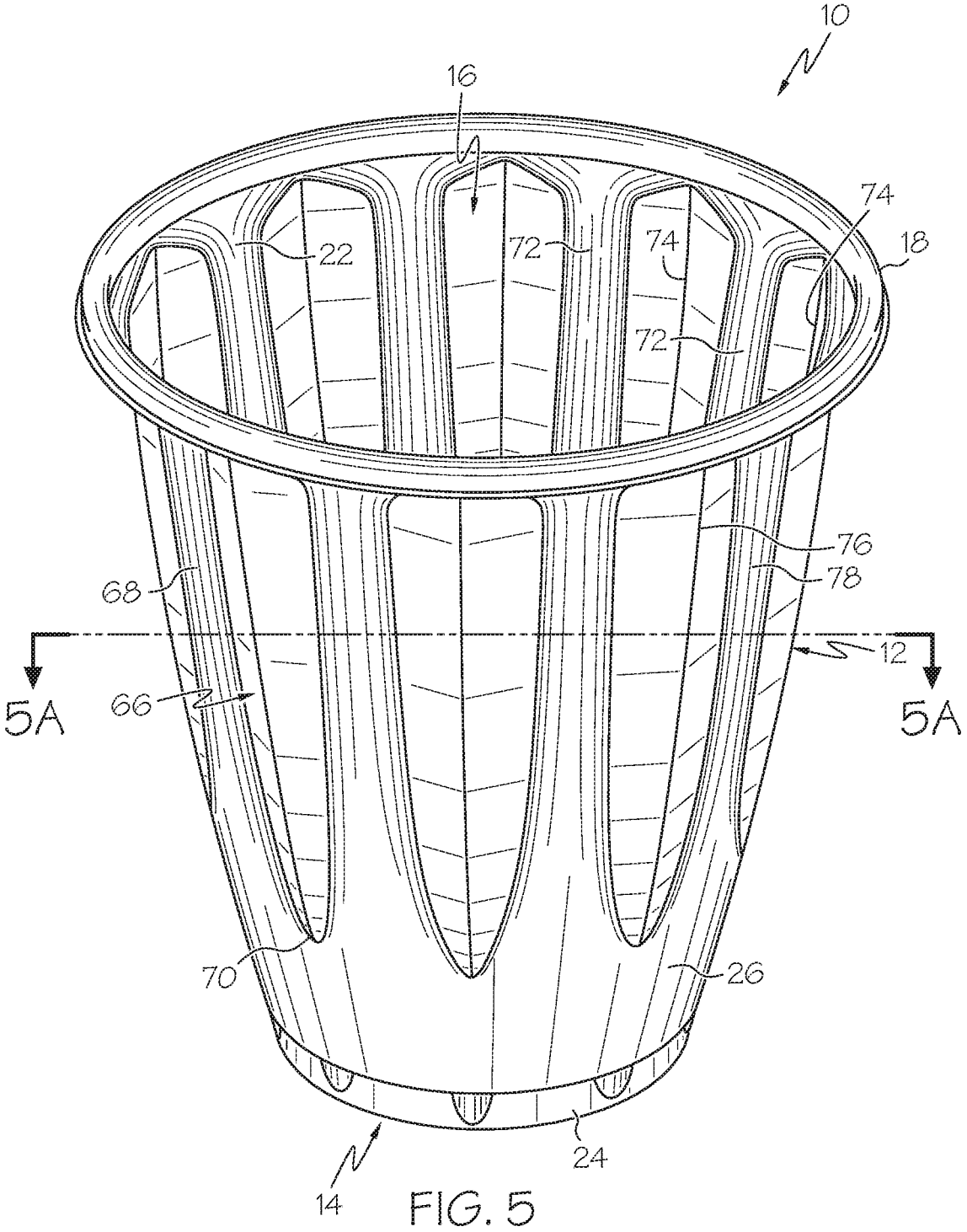
FIG. 5 is a side perspective view of a container having indentions in accordance with a preferred embodiment of the present invention.
Figure 5A:
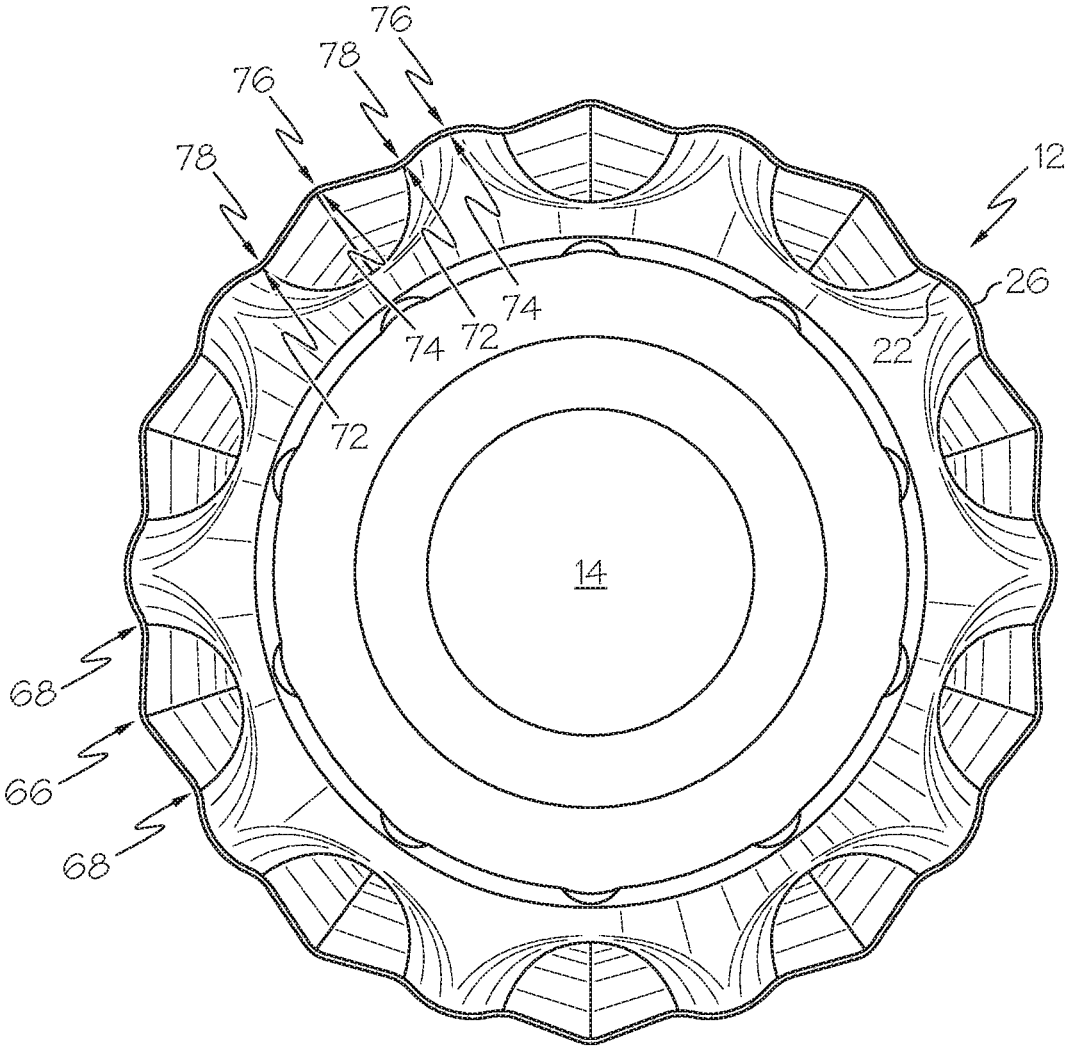
FIG. 5A is a sectional view of the container of FIG. 5 taken generally along line 5A-5A in the direction of the arrows in accordance with a preferred embodiment of the present invention.

FIGS. 5 and 5A show yet another embodiment of a container 10.2 including an alignment structure 66 comprising a plurality of circumferentially-spaced indentions 68. The indentions 68 form a parabolic-like shape and have a v-shaped lower edge 70. Because the alignment structure 66 is recessed into the sidewall 12, a resulting alternating series of generally radially intermittent, circumferentially-spaced peaks 72 and valleys 74 are formed into the interior surface 22 of the sidewall 12. Due to its formation into the sidewall 12, the alignment structure 66 also results in an alternating series of generally circumferentially-spaced peaks 76 and valleys 78 formed into the exterior surface 26 of the sidewall 12. Such a design allows for more stacking alignment opportunities as the container 10.2 may include more peaks 72 and 76 and valleys 74, and 78 than compared with other containers. For example, in one embodiment, the container 10.2 includes approximately 20 or more peaks 72 and 76 and the same number of corresponding valleys 74 and 78. Such an embodiment generally requires the container 10.2 to undergo less rotation in order to become aligned with an adjacent container 10.2 than embodiments having fewer alignment structures that are spaced radially further apart from one another. In principal, the alignment structure 66 of this embodiment operates in a manner similar to the alignment structure 30 of the first embodiment described above in order to align the containers together as they are stacked. Like the other embodiments described above, the alignment structure 66 can increase the structural rigidity and integrity of the sidewall 12 and can provide the sidewall 12 with contoured edges which aid a user in gripping the container 10.2.

Figure 6:
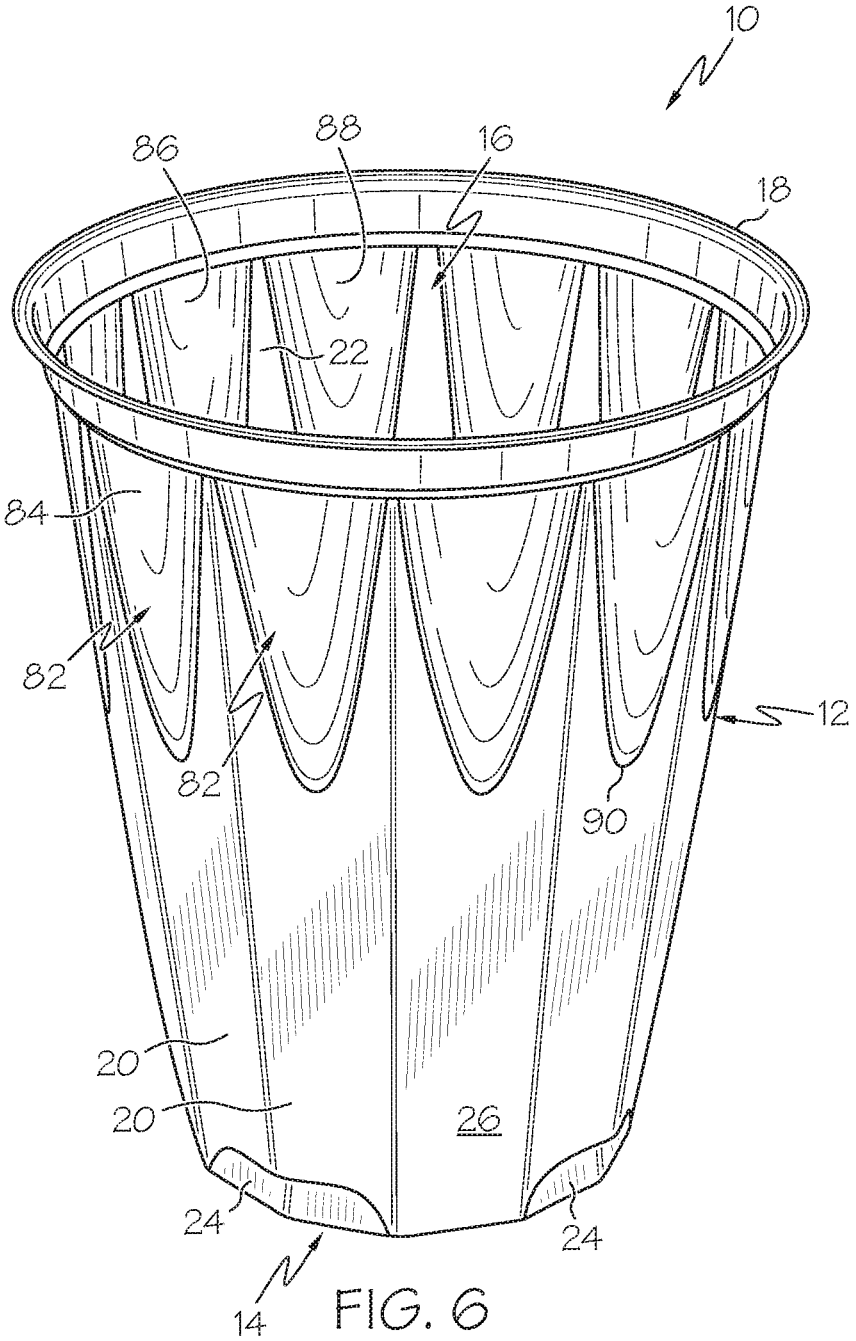
FIG. 6 is a side perspective view of a container having protrusions in accordance with a preferred embodiment of the present invention.

FIG. 6 illustrates a further embodiment of a container 10.3 having an alignment structure 80 comprising a generally parabolic-shape protrusion 82 extending from each sidewall panel section 20. The protrusions 82 include an exterior surface 84 extending or bulging from the outer surface 26 of the panel sections 20 and a corresponding interior surface 86 recessed into the interior surface 22 of the panel sections 20 that forms a valley 88. The protrusion may from a v-shaped lower edge 90. In principal, the alignment structure 80 of this embodiment operates in a manner similar to the alignment structures of the other embodiments described above. As one container 10.3 is being stacked with a second generally identical container (not shown), the protrusion 82 of the inner container engages the valley 88 of the outer container. As the two containers move closer together during the stacking process, the containers become aligned such that the sidewall panel sections 20 of the containers are aligned substantially parallel to one another. Like all the other embodiments described herein, the alignment structure 80 can also increase the structural rigidity and integrity of the sidewall 12 and can provide the sidewall 12 with contoured edges which aid a user in gripping the container 10.3.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A container comprising:

a bottom wall;

a frustoconical sidewall extending upward from said bottom wall, said sidewall including a plurality of axially-extending alignment structures circumferentially spaced around said sidewall and extending at least a portion of a height of said sidewall;

an exterior surface of said sidewall;

an interior surface of said sidewall, said interior surface radially and axially conforming to said exterior surface of said sidewall; and at least one of a rib, peak and indention formed on said exterior surface of said sidewall between one said alignment structure and an adjacent said alignment structure;

wherein each of said axially-extending alignment structures comprises first and second oppositely-sloping faces, said faces intersecting along a longitudinally-extending apex;

wherein said container is capable of being fully nested within a second identical container;

wherein said plurality of axially-extending alignment structures form a plurality of intermittent valleys in said exterior surface of said sidewall corresponding to a plurality of intermittent peaks on said interior surface of said sidewall;

wherein said sidewall comprises a plurality of sidewall panel sections, wherein each of said sidewall panel section includes one of said plurality of axially-extending alignment structures;

wherein said sidewall panel sections are orientated relative to one another so that said sidewall has a polygonal cross-sectional shape.

2. The container of claim 1, wherein each of said plurality of axially-extending alignment structures includes a v-shaped lower edge.

3. The container of claim 1, wherein said plurality of axially-extending alignment structures form a plurality of intermittent peaks on said exterior surface of said sidewall corresponding to a plurality of intermittent valleys in said interior surface of said sidewall.

4. The container of claim 3, wherein said intermittent peaks on said exterior surface of said sidewall of said container are configured for being received by said intermittent valleys in said interior surface of said sidewall of said second container when said container is nested within said second container.

5. The container of claim 1, wherein said first and second faces of each said axially-extending alignment structure are recessed inwardly to form one of said plurality of intermittent valleys in said exterior surface of said sidewall.

6. The container of claim 5, wherein said intermittent valleys in said exterior surface of said sidewall of said container are configured for receiving said intermittent peaks on said interior surface of said sidewall of said second container when said container is nested within said second container.

7. The container of claim 1, wherein said ribs are located at corners formed at intersections of adjacent said sidewall panel sections.

8. A container comprising:

a bottom wall;

a plurality of sidewall panel sections extending upward from said bottom wall, said plurality of sidewall panel sections forming a frustoconical sidewall having a polygonal cross-sectional shape and an interior surface that conforms to an exterior surface;

a plurality of axially-extending alignment structures, each said sidewall panel section having a respective axially-extending structure positioned thereon, each said axially-extending alignment structure containing two oppositely-sloped faces intersecting one another at a longitudinal apex defined in said axially-extending alignment structure; and a plurality of longitudinal ribs defined in said sidewall, each said longitudinal rib positioned between two adjacent axially-extending alignment structures;

wherein said two oppositely-sloped faces of each axially-extending alignment structure extend radially inward relative to said sidewall in the direction of said longitudinal apex forming valleys along said longitudinal apex on said exterior surface of said sidewall and peaks along said longitudinal apex on said interior surface of said sidewall;

wherein said container is capable of being fully nested within a second identical container.

9. The container of claim 8, wherein said ribs are located at corners formed at intersections of adjacent said sidewall panel sections.

* * * * *